US006109985A

United States Patent [19]

Dubois et al.

[11] Patent Number: 6,109,985

[45] Date of Patent: Aug. 29, 2000

[54] PROPELLER DEFLECTION SNUBBER

[75] Inventors: Neil J. Dubois, Cranston; Robert J. Obara, Portsmouth, both of R.I.

[73] Assignee: The United States of America as represented by the Secretary of the Navy, Washington, D.C.

[21] Appl. No.: 09/267,904

[22] Filed: Mar. 2, 1999

[51] Int. Cl.[7] ..... B63H 1/16

[52] U.S. Cl. ..... 440/67; 416/179; 114/338

[58] Field of Search ..... 440/66, 67, 77, 440/72; 114/315, 338; 416/179, 185, 189, 190

[56] References Cited

U.S. PATENT DOCUMENTS 3,063,394 11/1962 Rebikoff ..... 114/315

FOREIGN PATENT DOCUMENTS 425723 5/1991 European Pat. Off. ..... 440/67

*Primary Examiner*—Jesus D. Sotelo

*Attorney, Agent, or Firm*—Michael J. McGowan; James M. Kasischke; Prithvi C. Lall

[57] ABSTRACT

A deflection snubber assembly for preventing damage to a propeller which is subjected to instances of high force is disclosed. The propeller includes a hub for mounting the propeller on a shaft and a number of blades extending radially outward from the hub. Outer tips of the number of blades are interconnected by a continuous, circular band. The propeller is constructed to accommodate a predetermined amount of deflection upon instances of high force before being permanently damaged. The deflection snubber assembly includes a housing circumferentially surrounding the propeller, the housing having a number of deflection limiting members, each of the deflection limiting members limiting deflection of the propeller to within the predetermined amount of deflection upon occurrences of the instances of high force.

11 Claims, 4 Drawing Sheets

PROPELLER DEFLECTION SNUBBER

STATEMENT OF GOVERNMENT INTEREST

The invention described herein may be manufactured by or for the Government of the United States of America for governmental purposes without the payment of any royalties thereon or therefor.

BACKGROUND OF THE INVENTION (1) Field of the Invention

This invention relates generally to a system for preventing damage to a propeller, and more particularly to an apparatus for preventing a propeller of a countermeasure device from deflecting to the point of being damaged.

(2) Description of the Prior Art

Underwater vehicles, such as torpedoes and countermeasures, such as torpedoes, utilize a propeller system to provide hovering and transit capabilities. An example of such a propeller system is shown in FIG. 1, which is a partial cross-section view of a countermeasure device 100. Countermeasure device 100 includes a nose portion 102 and a tail portion 104. Tail portion 104 includes a tail cone 106, a shroud 108 and a two-bladed propeller 110 mounted on a shaft 112, which is driven by a motor located within tail cone 106. FIG. 1 shows a cross-section view of shroud 108 only, all other features are shown in full. FIG. 1A shows an end view of countermeasure device 100, including tail cone 106, shroud 108 and two-bladed propeller 110. Shroud 108 includes shroud supports 113 and shroud ring 114. Countermeasure device 100 is mounted inside a launch tube 116 of a vessel 118, as shown in FIG. 2. When countermeasure device 100 is launched, it pushes end cap 120 of launch tube 116 open. Upon the opening of end cap 120, water 122 rushes into launch tube 116 at a pressure which varies depending on the depth in water 122 that the launch tube 116 is located. The difference in pressure between launch tube 116 and water 122 creates a water hammer which can impact propeller 110 and shaft 112 with great force. The force with which the water hammer impacts propeller 110 and shaft 112, both when entering launch tube 116 and after impacting rear wall 124 of launch tube 116 and then exiting launch tube 116, can be great enough to cause propeller 110 and, consequently, shaft 112 to deflect, permanently damaging propeller 110 and shaft 112, thereby rendering the countermeasure device 100 less maneuverable or inoperable.

SUMMARY OF THE INVENTION

It is therefore the object of the invention to provide a system for preventing permanent damage to the propeller and shaft of a countermeasure device due to the water hammer created when the countermeasure device is launched. Another object is to provide a low-cost and mechanically simple system which does not require launch tube modifications.

The invention includes a tail section having a housing which surrounds a banded propeller. The housing includes a deflection snubbing section which provides a physical stop to limit the deflection of the banded propeller in both the fore and aft directions. The deflection snubbing section includes a number of inwardly extending extensions and raised portions, each also having a compressible liner attached to an inside surface thereof. The banded propeller is mounted on the shaft of the countermeasure device so that its band is located between the extensions and raised portions. When the propeller is subjected to high forces due to the water hammer created during a launch, the extensions and raised portions act as physical stops to prevent the propeller from deflecting enough to permanently damage the propeller and the shaft.

In a preferred embodiment of the invention, a deflection snubber assembly for preventing damage to a propeller which is subjected to instances of high force is disclosed. The propeller includes a hub for mounting the propeller on a shaft and a number of blades extending radially outward from the hub. The outer tips of the blades are interconnected by a continuous, circular band. The propeller is constructed to accommodate a predetermined amount of deflection upon instances of high force before being permanently damaged. The deflection snubber assembly includes a housing circumferentially surrounding the propeller, the housing having a number of deflection limiting members, each of the deflection limiting members limiting deflection of the propeller to within the predetermined amount of deflection upon occurrences of the instances of high force.

A method for preventing damage to a propeller which is subjected to instances of high force is also disclosed. The method includes limiting the deflection of the propeller within a predetermined amount upon instant occurrences of high force. dr

BRIEF DESCRIPTION OF THE DRAWINGS

The invention will be described with reference to the appended drawings, wherein.

Figure 1:
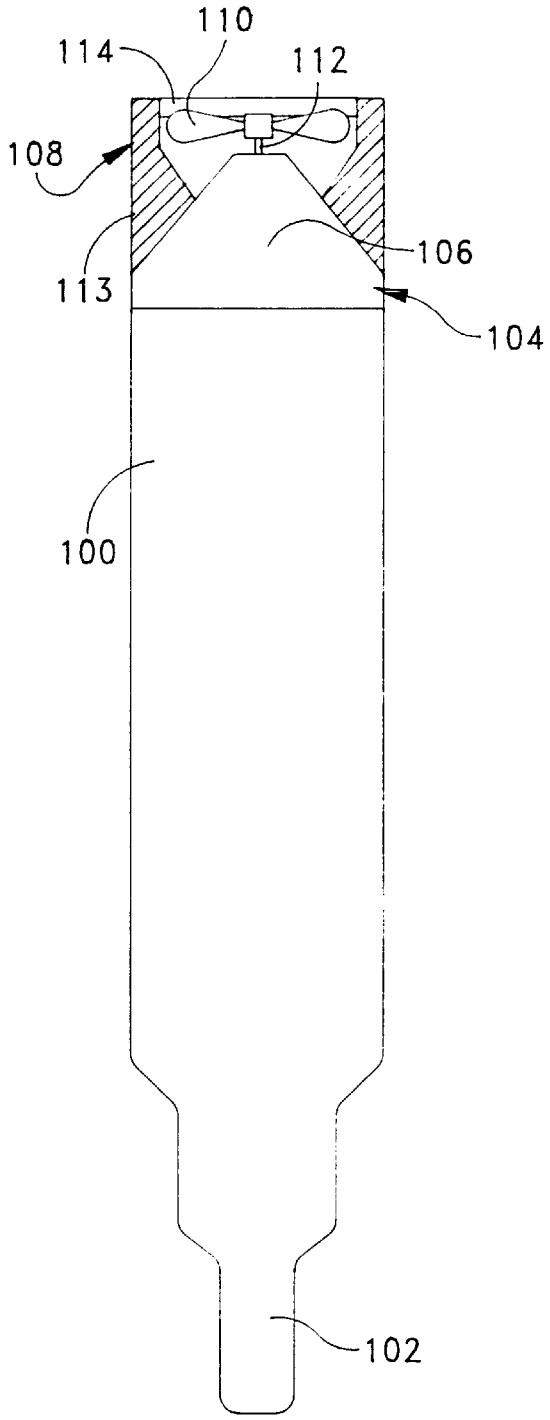
FIG. 1 (PRIOR ART)
FIG. 1 is a partial cross-section view of a conventional countermeasure device.
Figure 1A:
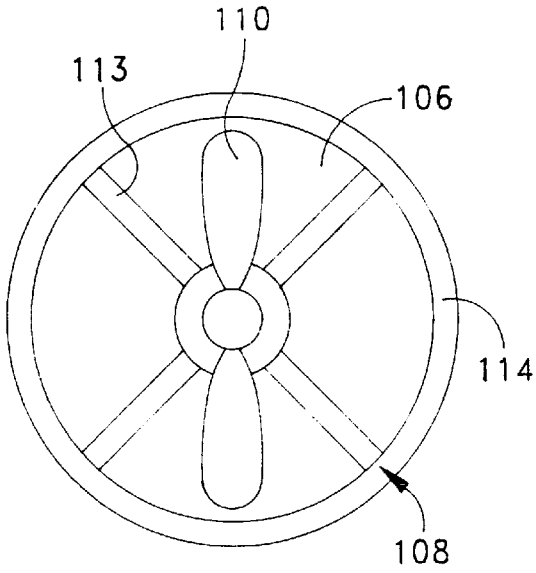
FIG. 1A (PRIOR ART)
FIG. 1A is an end view of the tail portion of the countermeasure device of FIG. 1.

Common features of the invention are identified with common reference numerals in the multiple views provided of the invention.

DESCRIPTION OF THE PREFERRED EMBODIMENT

Figure 5:
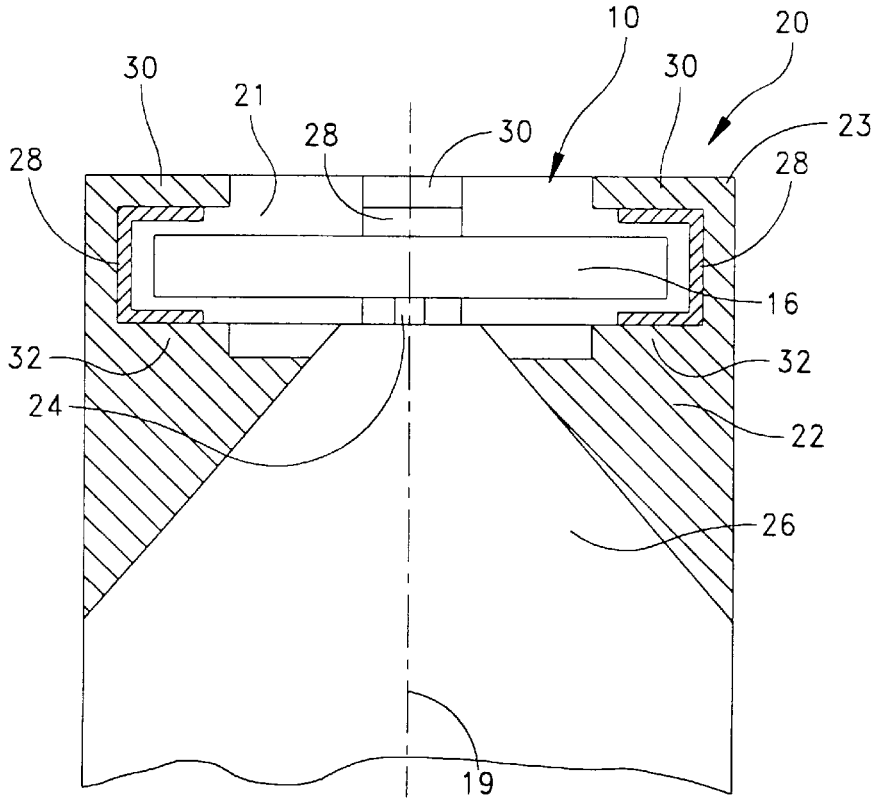
FIG. 5 is a partial cross-section side view of a countermeasure device including the deflection snubber in accordance with the present invention.
Figure 4:
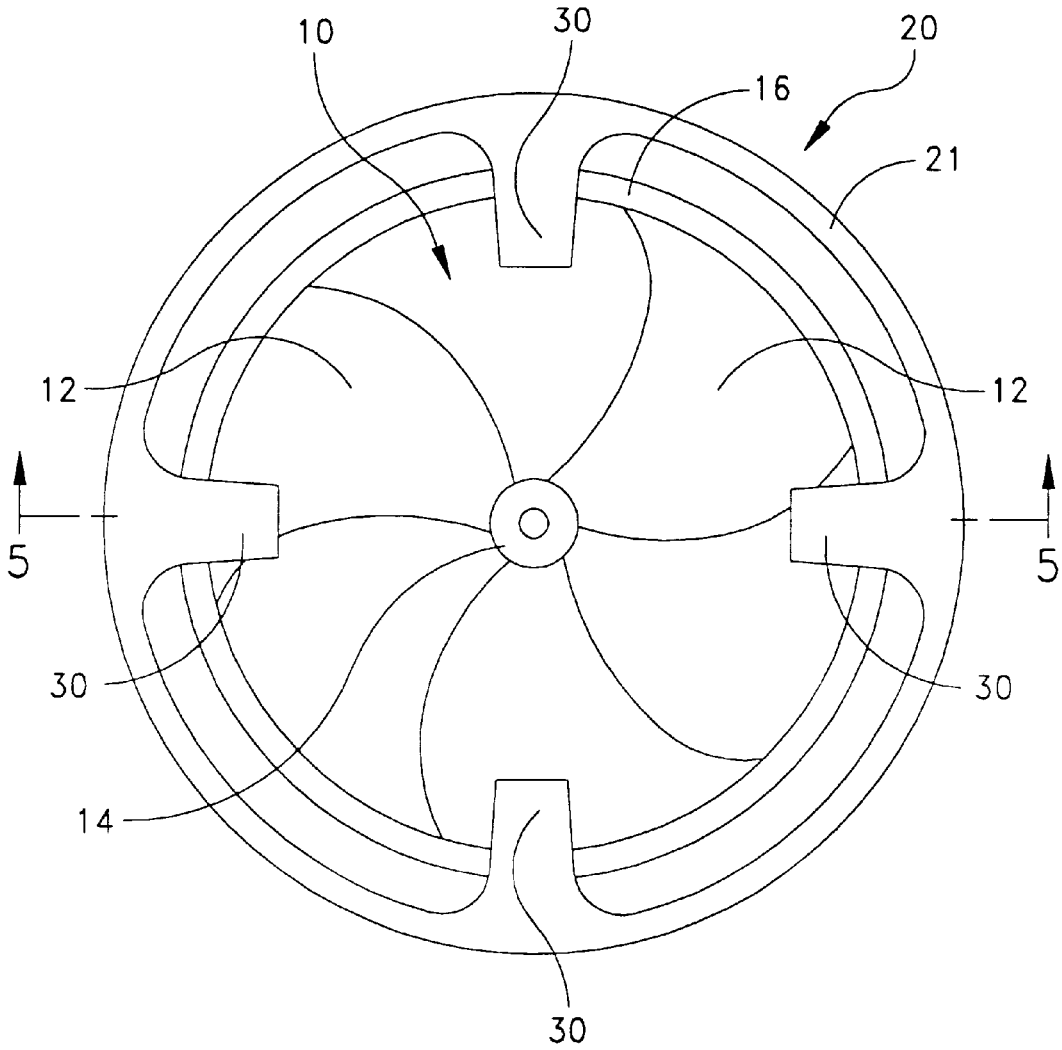
FIG. 4 is an end view of a countermeasure device including the deflection snubber of the present invention.

The propeller and deflection snubber assembly of the present invention is illustrated most clearly in FIGS. 4 and 5. As will hereinafter be more fully described, the general basis for the invention is for the propeller and snubber to cooperate to limit the potential deflection of the propeller blades and the propeller shaft to within predetermined limits relative to a longitudinal axis 19 of the countermeasure device, shown in FIG. 5, which will not permanently damage the propulsion system. Deflection of the propeller blades is generally limited by providing a banded propeller, while deflection of the propeller shaft is limited by enclosing the banded propeller within a housing having a compressible liner.

Figure 3:
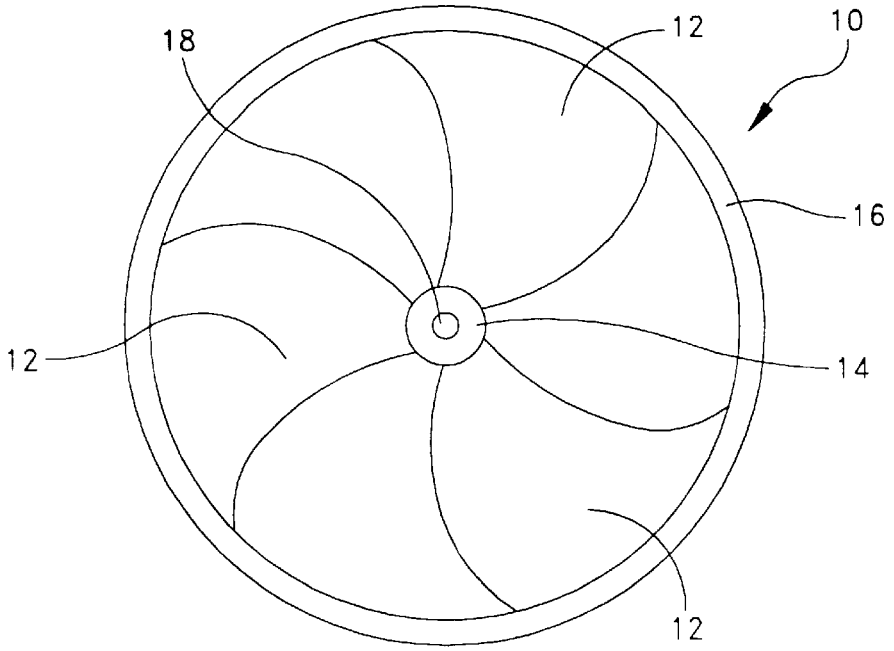
FIG. 3 is a perspective view of a banded propeller used in accordance with the present invention.

FIG. 3 shows a banded propeller 10 which is used in conjunction with the present invention. Propeller 10 includes a number of blades 12 connected between a hub 14 and a band 16. Hub 14 includes a hole 18 to facilitate mounting propeller 10 on a shaft. While, in this description, propeller 10 is shown having three blades 12, it will be understood that a propeller having any number of blades may be used in conjunction with the present invention.

In general, the propeller 10 and shaft are manufactured from materials having some flexibility so that they can withstand a predetermined amount of flexure or deflection before being permanently damaged.

FIG. 4 shows the deflection snubbing assembly of the present invention. FIG. 5 is a partial cross-sectional view of the present invention, showing propeller 10 in full and a housing 20 in cross-section, taken along line 5—5 in FIG. 4. As shown in FIGS. 4 and 5, propeller 10 is mounted on a shaft 24 inside housing 20, which is mounted to tail cone 26 of a countermeasure device.

Housing 20 includes a wall portion 21 and a base portion 22, which is mounted on tail cone 26. Housing 20 is preferably made from aluminum. However, it will be understood that any suitable material can be used in the formation of housing 20. Extending radially inward, over propeller 10, from the top of wall 21 are four extensions 30, located equidistant from each other along wall 21. Extensions 30 have a length which is approximately one-third the distance between wall 21 and hub 14 and a width approximately half of its length. Base portion 22 includes four raised portions 32 which are formed on base portion 22 and positioned along wall 21, under propeller 10, to coincide with extensions 30. Raised portions 32 have the same dimensions as extensions 30. A strip 28 of a compressible material, such as rubber, is attached along the inside surface of each extension 30, raised portion 32 and the part of wall portion 21 that interconnects each extension 30 to its corresponding raised portion 32.

Figure 2:
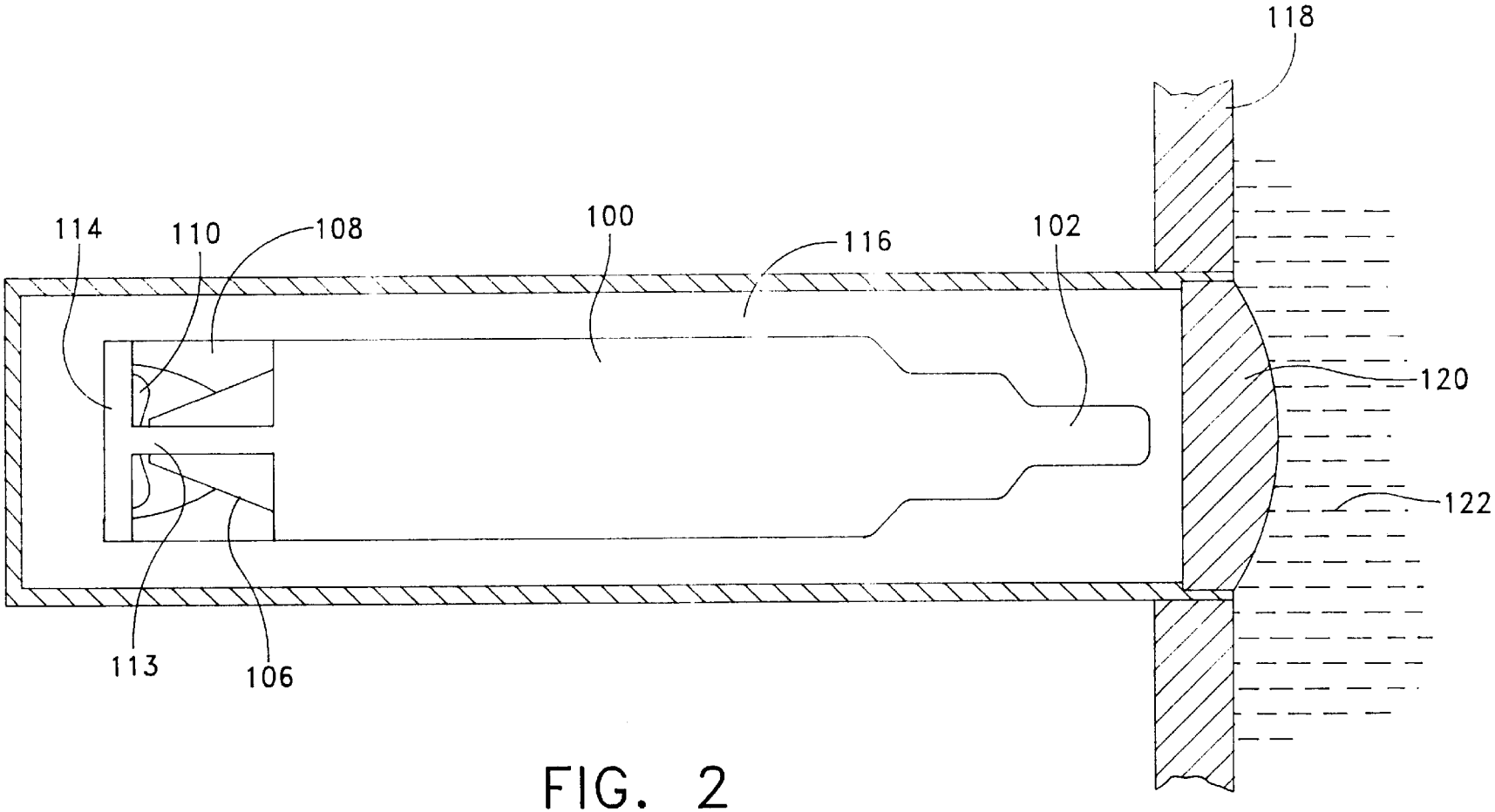
FIG. 2 (PRIOR ART)
FIG. 2 is a partial cross-section view of the countermeasure device of FIG. 1 mounted inside a launch tube of a marine vessel.

The operation of the countermeasure propeller deflection snubber of the present invention will now be discussed. As described previously, when a countermeasure device, such as that shown in FIG. 2, is launched from a marine vessel, the nose of the countermeasure device pushes the end cap out from the marine vessel. As a result, water enters the launch tube with enough force to permanently damage prior art propeller systems. In the present invention, when the water impacts the propeller 10 upon its entrance into the launch tube and upon its exit from the launch tube after impacting the back wall of the launch tube, damage to the propeller 10 is prevented in two ways. First, band 16, which connects the outer edges of blades 12, increases the lateral rigidity of the propeller, thereby making the propeller less likely to deflect relative to longitudinal axis 19 when impacted with water. Second, in the event that propeller 10 is impacted with enough force to cause propeller 10 to deflect, extensions 30 and raised portions 32 limit the deflection of propeller 10 by providing a physical stop for band 16 to snub deflections of the propeller 10. In other words, when propeller 10 experiences enough force from incoming water to deflect an amount that would cause damage to propeller 10, band 16 will contact either extensions 30 or raised portions 32, depending on the direction of deflection. Extensions 30 and raised portions 32 stop the deflection of propeller 10 before the propeller deflects an amount which will cause permanent damage to propeller 10 and the shaft 24. Strips 28 prevent damage to band 16 due to the impact of band 16 with extensions 30 and raised portions 32.

The distance between extensions 30, raised portions 32 and wall 21 and propeller 10 and the thickness of strips 28 are chosen to limit any deflection of propeller 10 to an amount that will not permanently damage propeller 10 or shaft 24, while allowing enough space for water to flow around propeller 10. As can be seen in FIG. 4, extensions 30, which extend inward, toward hub 14 of propeller and raised portions 32 are also positioned around the circumference of wall 21 with enough distance between them to allow proper inflow and outflow of water into housing 20 to allow propeller 10 to effectively generate the thrust needed to propel the countermeasure device.

While there is shown and described herein certain specific structure embodying the invention, it will be manifest to those skilled in the art that various modifications and rearrangements of the parts may be made without departing from the spirit and scope of the underlying inventive concept. For example, the number, shapes and sizes of the extensions and raised portions may be varied to accommodate differently sized or constructed propellers. The material used for the strips 28 and their thickness may also be varied, depending on the size and construction of the propeller. Therefore, the invention is not limited to the particular forms herein shown and described except insofar as indicated by the scope of the appended claims.

What is claimed is:

1. A deflection snubber assembly for preventing damage to a propeller, comprising:

a band mounted circumferentially about said propeller;

a housing positioned circumferentially to said propeller; and a plurality of deflection limiting members mounted on said housing, said deflection limiting members limiting said band to limit deflection of said propeller.

2. The assembly as in claim 1 wherein said propeller is joined by a shaft to a vessel, said deflection snubber further comprising a plurality of supports joined to said housing and said vessel for positioning said housing about said propeller.

3. The assembly as in claim 2, wherein each deflection limiting member includes a compressible liner mounted thereto between said propeller and said member.

4. The assembly of claim 2, comprising four deflection limiting members arranged at equal intervals on said housing.

5. A propulsion system for a vehicle comprising:

a shaft extending into said vehicle;

a banded propeller mounted on said shaft, said propeller having a plurality of blades and a band mounted circumferentially at the extremity of the blades;

a plurality of supports joined to said vehicle;

a housing mounted on said supports surrounding said banded propeller; and a plurality of deflection limiting members joined to said housing, said deflection limiting members capable of interacting with said band to prevent excessive deflection of said banded propeller and said shaft.

6. The device of claim 5 wherein said banded propellers and said shaft are constructed to accommodate deflection when subjected to instances of high force.

7. A propeller arrangement for an underwater vessel comprising:

a banded propeller having a shaft mounted within the underwater vessel, said shaft having sufficient axial flexibility to accommodate a predetermined amount of axial deflection; and a deflection snubber assembly mounted on the underwater vessel and having a housing circumferentially surrounding said banded propeller and a limiting means positioned within said housing for limiting the axial deflection of said propeller to within said predetermined amount of axial deflection.

8. The propeller arrangement of claim 7, wherein said limiting means comprises a number of extensions extending inwardly from a circumference of said housing, each of said number of extensions comprising an inner stop and an outer stop, said propeller being mounted within said housing and between said inner and outer stops of each of said number of extensions.

9. The apparatus of claim 8, wherein each of said number of extensions further comprises a compressible liner mounted on an inner surface thereof, proximate said propeller.

10. The apparatus of claim 9, comprising four extensions disposed on said housing.

11. The apparatus of claim 7, wherein said underwater vessel is a countermeasure device.

* * * * *